US005184881A

United States Patent [19]

Karpen

[11] Patent Number: 5,184,881

[45] Date of Patent: Feb. 9, 1993

[54] DEVICE FOR FULL SPECTRUM POLARIZED LIGHTING SYSTEM

[76] Inventor: Daniel N. Karpen, 3 Harbor Hill Dr., Huntington, N.Y. 11743

[21] Appl. No.: 781,844

[22] Filed: Oct. 24, 1991

Related U.S. Application Data

[63] Continuation-in-part of Ser. No. 489,494, Mar. 7, 1990, abandoned.

[51] Int. Cl.[5] ..... F21V 9/02; F21V 9/14

[52] U.S. Cl. ..... 362/1; 362/19; 362/217

[58] Field of Search ..... 362/1, 2, 19, 217, 223, 362/260, 267, 253, 147, 404

[56] References Cited

U.S. PATENT DOCUMENTS

| | | | |
|---|---|---|---|
| 2,421,447 | 6/1947 | Watkins | 362/404 |
| 3,517,180 | 6/1970 | Semotan | 362/1 |
| 3,670,183 | 6/1972 | Thorington et al. | 313/485 |
| 4,091,441 | 5/1978 | Ott | 362/1 |
| 4,298,916 | 11/1981 | Shemitz | 362/19 |
| 4,414,493 | 11/1983 | Henrich | 315/308 |
| 4,580,200 | 4/1986 | Hess et al. | 362/223 |
| 4,613,929 | 9/1986 | Totten | 362/150 |
| 4,796,160 | 1/1989 | Kahn | 362/19 |
| 4,910,650 | 3/1990 | Goralnik | 362/147 |
| 4,956,751 | 9/1990 | Kano | 362/1 |

*Primary Examiner*—Richard R. Cole
*Attorney, Agent, or Firm*—Alfred M. Walker

[57] ABSTRACT

A full spectrum polarized lighting fixture for general commercial, institutional, and industrial use, and for use in offices with computer terminals and video display terminals. The lighting fixture contains an electronic solid state ballast, a polarizing lense, and a full spectrum color corrected lamp. The lense is a polarized diffuser to provide glare free light with excellent contrast. The fixture contains a full spectrum color corrected lamp to simulate daylight. The combination of the full spectrum lamp and the polarized diffuser provides for light with the spectral energy distribution characteristics and light polarization of natural daylight.

5 Claims, 1 Drawing Sheet

DEVICE FOR FULL SPECTRUM POLARIZED LIGHTING SYSTEM

This application is a continuation-in-part of application Ser. No. 07/489,494, filed Mar. 7, 1990 now abandoned.

BACKGROUND OF THE INVENTION

1. Field of the Invention

The present invention relates to a full spectrum polarized fluorescent lighting fixture for general purpose lighting for commercial, institutional, and industrial use. The lighting fixture will provide flicker free, glare free light of excellent color rendition. This fixture is also designed to be used in spaces with personal computers or video display terminals. The polarizing lense provides glare free light that gives excellent contrast and sharp images. The lighting fixture is equipped with a full spectrum lamp to provide light that will match the color rendering properties of natural daylight, and to eliminate eyestrain. The lighting fixture also has a solid state ballast that does not flicker.

Ever since the invention of the incandescent light bulb, attempts have been made to reproduce natural light. Full spectrum lamps have been developed utilizing a combination of phosphors which produce ultraviolet as well as visible light in approximately the same proportion as found in natural daylight. Full spectrum lamps are defined as a lamp with a Color Rendition Index of 90 or above and a Color Temperature of 5,000 degrees or above. Such a fluorescent lamp is disclosed, for example, in U.S. Pat. No. 3,670,193.

The novel illuminating system according to my invention makes it possible for the first time expediently to provide artificial light which has the spectral energy distribution and light polarization characteristics of natural daylight. Such an artificial lighting system was first noted in "Designing Efficient Full Spectrum Polarized Lighting Systems for the Electronic Office, by Daniel Karpen, P. E., in *Strategies For Reducing Natural Gas, Electric, and Oil Costs* (Proceedings of the 12th World Energy Engineering Congress, Oct. 24–27, 1989, published by the Association of Energy Engineers, Atlanta, Ga.). Such a combination comprises a lighting system which will produce light providing great visual acuity.

It is well known that light scattered by the atmosphere is highly polarized (see for example, "Light Scattering in the Atmosphere and the Polarization of Light", by Z. Sekera, *Journal of the Optical Society of America*, June, 1957, Vol. 47, p. 484). The degree of light polarization in the atmosphere was carefully measured by Z. Sekera, and it is of the same order of magnitude as the amount of light polarization produced by commercially available polarized diffusers for fluorescent lighting fixtures. It is easy to demonstrate that daylight from the sky is polarized by the atmosphere: take a linear polarizer and rotate while looking at the sky. One will notice a darkening and lightening of the linear polarizer as it is rotated through 90 degrees. Maximum polarization is seen while looking in the sky at an angle of 90 from the direct beam of the sun.

However, full spectrum lamps used by themselves are lacking the polarizing characteristics of natural daylight, and produce glare when used in lighting fixtures without polarized diffusers. The subject of the invention is a fixture that contains both the full spectrum lamp and the polarized diffuser to achieve the desired result of an artificial lighting system that has both the spectral energy distribution and light polarization characteristics of natural daylight.

For some time, there has been a great deal of dissatisfaction with conventional fluorescent lighting systems. For the computerized office, with personal computers and video display terminals, there is a great deal of glare from conventional fluorescent fixtures. The present technology of using core coil ballasts, cool-white or warm-white lamps, and prismatic or parabolic lenses contributes to fatigue, eyestrain, and glare in interior lighting, resulting in a substantial loss of employee productivity.

While it has been known that visibility is related to the amount of light present (measured foot-candles), there are other fundamental characteristics concerning vision, task visibility, and lighting which are of equal or greater importance than quantity alone. "Seeing" is not related to foot-candles per se. It is mostly a function of the luminance (brightness) of the task detail and its contrast with the background. The first of these factors is dependent on the task detail reflectance—how much of the light reaching the task has been absorbed by it and re-reflected, so it can be seen.

The other factor, contrast, is the difference in task brightness between the task detail and its background. Gray printing on lighter gray background can be very difficult to see. Contrast is very important to "Seeing".

The nature of light and the lighting system can affect both the brightness of the task detail and its contrast. One can easily see just how much difference it makes. If one takes a printed object, such as a magazine or book, and places it on a table under a light source located slightly to the front of it, one will notice that the print detail looks "washed out".

If one moves around to the side, the print will appear darker. What has happened is that the contrast of the print to the background has increased. In the first instance, the light bouncing off the task reduced its contrast due to reflected glare, also called "veiling reflections." These reflections are due to light which is reflected from the task surface without actually obtaining information on them. In the second instance, the reflections went off in the other directions than to the eye, so they did not wash out the contrast between the object detail and the background.

The portion of the light rays which cause reflected glare or veiling reflections is that which is horizontally polarized. The vertically polarized portion of the light penetrates into the task (instead of bouncing off its surface) and returns to the eye carrying information about the task, detail and color. If, therefore, one illuminates an object so the horizontally polarized component of the light is not present, one obtains a much higher contrast and one is able to see detail and color much better. This is how multi-layer polarizing diffusers function. They convert the horizontally vibrating light rays emitted from the lamp to preferentially vertically polarized light, thus increasing the amount of vertically polarized light rays available for penetrating into the task. (For a discussion of how multi-layer polarizers produce vertically polarized light, see, for example, Halliday, David, and Resnick, Robert, *Physics*, John Wiley & Sons, New York, 1966, pp. 1153–54. Generally, unless light is completely polarized in a given direction, it is appropriate to describe a less-than-complete degree of polarization by terms such as preferential or substantial. Thus, the expression "preferentially vertically polarized" refers to light which has been polarized substantially, but not completely, in a vertical direction.) As a result, the reflections are reduced, and the visual contrasts enhanced significantly. The visual effectiveness and "Seeing" are thus improved significantly.

If contrast is improved, then one requires "less light" to see tasks equally as well. If one improves the contrast, one can reduce the amount of light (measured foot-candles) one needs to achieve equivalent visual performance. This is how vertically polarized light functions. Test results indicate a reduction of as much as 50 percent in measured foot-candles to achieve equivalent visual performance as noted in report LRL 188-9, prepared by Lighting Research Laboratory, P.O. Box 6193, Orange, Calif. 92667, dated Jan. 13, 1988.

Thus the substitution of polarized diffusers in place of prismatic or parabolic diffusers immediately solves the veiling reflection problem. It has been known since 1973 that polarizing diffusers increase contrast as compared with prismatic or louvred (including parabolic diffusers), as noted in "Progress in Solving Veiling Reflections", *Lighting Design and Application*, May, 1973. The correct solution to solving the glare problem is to use vertically polarized light. Using vertically polarized light also eliminates the bright spots directly under a fixture as there is a more even and wider light distribution.

The importance of the color rendering quality of light sources has been well established for applications where color identification or comparison is involved, and some studies have been made to determine the importance of color rendition for general illumination.

Berman examined the visual effectiveness of a number of light sources under photopic (day vision) and scotopic (night vision) environments (Energy Efficiency Consequences of Scotopic Sensitivity, Lighting Systems Research Group, Lawrence Berkeley Laboratory, Berkeley, Calif. 94720, dated May 13, 1991). He found that at the light levels typical of interior illumination, the eye functions more in the scotopic region than in the photopic region.

The human eye is a light sensing system with an aperature (pupil) and a photoreceptive medium (retina). The retina contains two basic types of photoreceptors, cones and rods. The rod photoreceptors are generally associated with night vision and have been assumed to not participate in the visual process at light levels typical of building interiors. The cone receptors which are responsible for seeing fine detail and for color vision, provide the photopic visual spectral efficiency of the eye which is captured by the V(λ) function. Under conditions of very dim light, such as starlight, there is not enough light energy to stimulate the cone photoreceptors, but there is enough to stimulate the rod system as stars can be readily observed. The spectral response of the rod photoreceptors, the scotopic response function V'(λ), differs from the cone spectral response in that its wavelength peak response is at about 508 nm rather than the 555 nm of the V(λ) function.

Reductions in visual acuity occur with increasing pupil size for the normally sighted under conditions of moderate to low contrast but not necessarily at high contrast. However, individuals who need optical corrections, i.e., those who should be using spectacles because of myopia (nearsightedness) show decrements in visual acuity even at high levels of contrast. Many tasks in the workplace do not possess high contrast. Changes in acuity are similar to changes in threshold contrast as both are major determinants of visual performance potential. Conversely, at normal office lighting levels, photopic adaptation luminance is a weak determinant of visual performance potential. Therefore two sources with equal scotopic illumination, but moderately different photopic illumination (within a factor of two), should be very close in their performance potential. On the other hand, two sources with equal photopic illumination, but moderately different scotopic illumination, may have significantly different visual performance potentials.

By using the V(λ) and V'(λ) functions, one can calculate the photopic and scotopic lumens for a number of light sources. The scotopic output can be determined by folding the lamp spectral power distribution with the scotopic sensitivity function V'(λ) as given by Wyszecki and Stiles (Color Science, 2nd ed., Wiley, New York City (see page 105), 1982). Pupil size is then determined by a combination of photopic and scotopic lumens that can be thought of as a "pupil lumen" (see Berman et. al. "Spectral Determinants of Steady-State Pupil Size with Full Field of View", Lighting Systems Research Group, Lawrence Berkeley Laboratory, Berkeley, Calif. 94903 Report Number 31113, dated Feb. 19, 1991). Pupil lumens are determined by the factor $P(S/P)^{0.78}$, where P and S are the photopic and scotopic output of the lamp. The ratio of the scotopic to photopic luminance (or lumens) is referred to here as the (S/P) ratio. This ratio is a property of the lamp spectral power distribution (SPD). Generally, the pupil lumen is determined by the measured photopic output multiplied by the S/P ratio which is calculated from the measured SPD which is then folded with V(λ) and V'(λ). Based on the scotopic and photopic lumen outputs, the third column in Table 1, lists the values of the pupil lumens from each of the different spectral distributions. The fourth column in Table 1 shows the relative amounts of power required by these lamps for the condition of equal average pupil size, assigning a value of 100 to the cool white lamp. The last and most significant column compares the lamps on the basis of pupil lumens per watt which is proposed here as the measure of the visual effectiveness per watt for various 40 watt lamps.

TABLE 1

| Lamp | Photopic Lumens | Scotopic Lumens | Effective Pupil Lumens $P(S/P)^{.78}$ | Relative Power Level for Equal Pupil Sizes | Pupil Lumens Per Watt |
|---|---|---|---|---|---|
| Warm White Fluorescent | 3200 | 3100 | 3125 | 136 | 78 |
| Cool White Fluorescent | 3150 | 4630 | 4254 | 100 | 106 |
| F40/T10 5500° CRI 91 | 2750 | 5913 | 4996 | 85 | 125 |

Thus, from the point of view of providing optimum lighting for visual function, the F40/T10 5,500° CRI 91 lamp would require 15 percent less energy than the cool white lamp, and 40 percent less energy than the warm white fluorescent lamp.

By the use of the full spectrum lamps with the multi-layer polarized diffuser, the energy savings potential increases as compared with the cool white or warm white lamp. As discussed above, by utilizing a polarized diffuser, light levels can be cut in half for equal visual performance. Thus, when the full spectrum lamp replaces the cool white lamp, one needs only 85 percent of the energy to produce equivalent illumination; by placing a polarized diffuser with the full spectrum lamp, one needs only 42.5 percent of the original amount of energy for equivalent visual performance. Likewise, the use of the full spectrum lamp with the polarized diffuser in place of warm white lamps results in needing only 30 percent of the energy needed for equivalent illumination. This reduction in energy use in the full spectrum polarized lighting system can only occur when the polarized diffuser is used with the full spectrum lamp.

Use of electronic solid state ballasts is necessary to eliminate the flickering associated with fluorescent lamps driven by conventional core coil electromagnetic ballasts. Standard core coil ballasts produce a 60 cycle flicker at the ends of a fluorescent lamp and a 120 cycle flicker in the middle of the fluorescent lamp. Both types of flickering are subliminally noticeable. When video display terminals are viewed with fluorescent fixtures driven by standard core coil ballasts, both the VDT and the fluorescent lamps flicker at the line frequency, but rarely exactly in phase since both the VDT and the ballast are inductive devices. This out of phase flickering, called the strobe effect, is causing discomfort for VDT operators. The high frequency ballast eliminates this entirely. Evidence exists that the use of electronic ballasts improves productivity by about 10 percent, as noted in "Electronic Ballasts Produce Substantial Cost Savings", by Karen Haas Smith, *Building Design & Construction*, November, 1986 and "Superior Office Lighting—An Unusual Approach", by Arthur Freund, *Electrical Construction & Management*, November, 1983.

A solid state ballast with a 40 watt bipin four foot fluorescent lamp will consume approximately 40 watts. A solid state ballast driving two 40 watt bipin four foot fluorescent lamps will consume approximately 72 watts. A standard 4 lamp F40 fluorescent fixture driven by core coil ballasts will consume approximately 192 watts.

By the use of the full spectrum fluorescent lamp with the multi-layer polarized diffuser, as mentioned above, one can achieve essentially the same degree of visual performance with a single four foot F40/T10 full spectrum fluorescent lamp as with four F40 warm white lamps. Thus, it is possible to save a significant amount of electrical energy by the use of the full spectrum fluorescent lamp with the multi-layer polarized diffuser in place of the use of warm white lamps alone. If one drives the full spectrum fluorescent lamp by a solid state ballast, installing it a fluorescent fixture with the multi-layer polarized diffuser, one can save 152 watts of lighting instead of using a four foot fluorescent fixture with 4 warm white lamps.

The fixture housing is free of ventilation holes which permit air to ventilate the fixture. However, a solid state ballast produces far less heat, normally 1 to 3 watts compared with 8 to 16 watts produced by a conventional core coil type ballast. Thus, there is no need for ventilation holes. A major problem with ventilation holes is while they work well to cool the fixture, they do permit substantial amounts of dirt and dust to accumulate on the prism side of the polarized diffuser. Such accumulation of dirt and dust becomes difficult and costly to clean compared to simply wiping the smooth surface of a conventional prismatic diffuser which is installed with the flat side towards the lamps and the prism side towards the objects being illuminated by the fixture. The fully sealed fixture housing is an essential part of the fixture and the full spectrum polarized lighting system. The fixture also contains a gasket mounted on the door frame of the fixture between the door and the door frame to prevent dirt from entering around the door and door frame. The gasketing is also ultraviolet resistant to prevent deterioration subsequently preventing dirt from entering the fixture housing. Since a full spectrum lamp gives off ultraviolet light (see for example U.S. Pat. No. 3,670,193), one needs to use an ultraviolet light resistant gasketing, as otherwise the gasketing materials would deteriorate when ultraviolet light hits the gasketing materials.

2. Description of Prior Art

Scott (U.S. Pat. No. 3,201,576) teaches the use of several different fluorescent lamps in a fixture, each of which lamps produces a different spectral energy distribution, but when the lamps are turned on in combination, so called "north light" results. Semotan (U.S. Pat. No. 3,517,180) teaches the use of arrays of lamps of different colors intersecting at right angles to produce an artificial daylight effect. Thorington (U.S. Pat. No. 3,670,193) teaches the use of various combinations of phosphors inside a fluorescent lamp to obtain a light source providing light matching natural light. Ott (U.S. Pat. No. 4,091,441) shows the use of full spectrum fluorescent lamps in a luminaire in combination with a gas discharge lamp producing ultraviolet light to provide for a luminaire that produces artificial light with the light spectral energy distribution and ultraviolet distribution of natural light. Note that both Scott and Sematon use a combination of lamps to produce the full spectrum light, whereas Thorington and Ott use a single lamp that provides the spectral distribution of natural light in the visable light. Neither Thorington nor Ott use the multi-layer polarized diffuser in combination with the full spectrum lamps to produce a light source that has both the spectral energy distribution and light polarization characteristics of natural light. Kahn (U.S. Pat. No. 3,124,639) teaches the use of light polarizing materials and specifically to materials capable of polarizing light incident thereon through refraction and reflection. Kahn (U.S. Pat. No. 4,796,160) teaches a polarized lighting panel as an improved Radialens light control panel with a smooth bottom layer consisting of light polarizing materials. This polarizing lighting panel provides polarized light that is preferentially distributed to provide higher visual effectiveness and contrast, less reflective glare, increased visual comfort and less direct glare that could be obtained with a Radialens panel alone or from the polarizing sheet alone without the preferential distribution offered by the Radialens panel. However, in neither of Kahn's patents is it taught the use of the polarized diffuser with the full spectrum lamp to produce a lighting system with both the light polarization characteristics and spectral energy distribution of natural light as the combination of the full spectrum lamp with the polarized diffuser is necessary to duplicate natural light.

SUMMARY OF THE INVENTION

The invention is a lighting fixture for general interior use in the commercial, industrial, and institutional environment which combines a flat multi-layer polarized diffuser with a color corrected full spectrum lamp and in which the lamp is driven by a solid state electronic ballast. The fixture provides for full spectrum vertically polarized light of excellent color rendition. The light is flicker free without the annoying flicker produced by conventional core coil ballasts.

The fixture can be equipped with F40/T10, F40/T12, or F32/T8 fluorescent lamps. The fixture has a gasket to seal the door to the frame and has a dust proof housing using a specular reflector.

When equipped with two 40 watt fluorescent lamps, the fixture will draw only 72 watts and when equipped with one 40 watt lamp the fixture will draw 40 watts.

BRIEF DESCRIPTION OF THE DRAWINGS

The invention and its embodiments may be better understood by referring to the following drawing wherein like elements are referenced with like numerals.

DESCRIPTION OF THE PREFERRED EMBODIMENT

Figure 1:
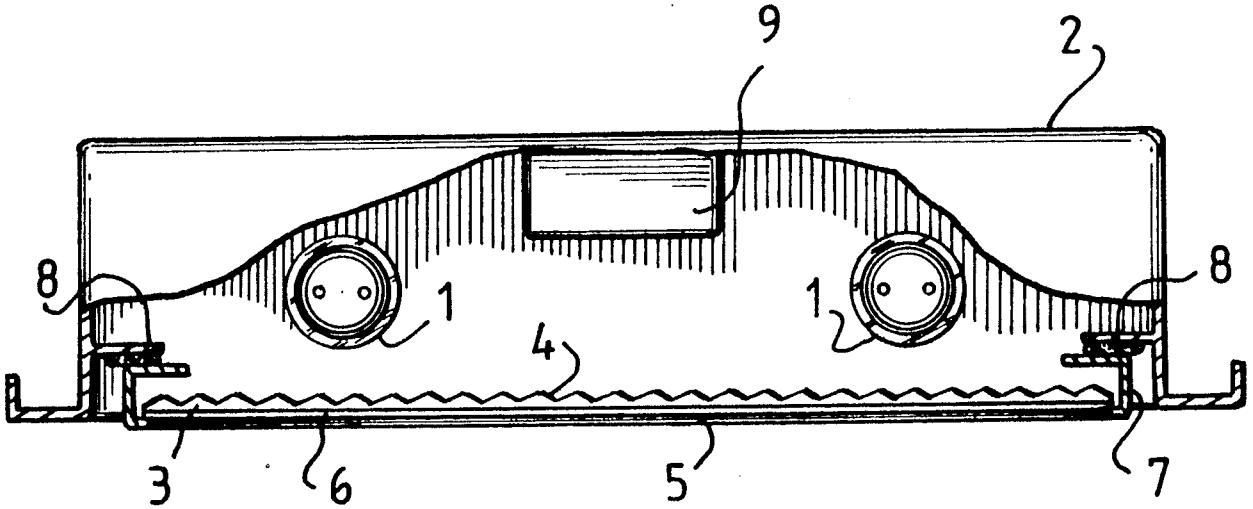
FIG. 1 is a side view of a two lamp troffer mounted fixture.

A vast improvement in visual performance is achieved in the full spectrum polarized lighting system which comprises full spectrum lamps in combination with a polarized diffuser. The fixture contains two full spectrum fluorescent lamps 1 mounted between the fixture housing 2 and a multi-layer polarized diffuser 3. The prism side 4 of the multi-layer polarized diffuser is towards the lamps and the smooth side 5 is towards the objects or room being illuminated by the fixture. The smooth side 5 is coated with a layer of polarizing material 6 which converts unpolarized light to preferentially vertically polarized light. The multi-layer polarized diffuser is mounted in the fixture door 7. There is an ultraviolet resistant gasket 8 which is between the fixture door 7 and the fixture housing 2. The lamps are driven by a solid state ballast 9.

The prism side of the multi-layer polarizer is towards the lamps to provide for proper light polarization. If the smooth side which contains the polarized layer is towards the lamps, there will be some depolarization of the light as it emerges from the prism side. In addition, the light distribution will be altered since the prism side will be down instead of being up.

In the preferred embodiment, the light polarization material used produces preferentially polarized light in a radial cone directly under any point in the fixture. A linear polarizer, such as the dichroic polarizers used in sunglasses, can only provide vertically polarized light in one direction. For an overhead lighting system, where viewing takes place from all directions, a linear polarizing material would provide for extremely uneven lighting in a room or an office, and would be highly unsatisfactory. In addition, the linear polarizers are only about 40 percent in transmitting light, as compared with efficiencies in the 70 to 85 percent range achieved by using a polarizing film which produces vertically polarized light. As one of the objectives of the full spectrum polarized lighting system is to improve vision and to be an energy efficient lighting system, such an approach using dichroic polarizing materials would not achieve the objectives of energy conservation and a visually efficient lighting system.

I claim:

1. A full spectrum polarized fluorescent lighting system which produces artificial light that is of the spectral energy distribution and light polarization characteristics of natural daylight comprising in combination:

a ceiling mounted fluorescent fixture;

a flat multi-layer polarized diffuser mounted in a door of said fixture; said flat multi-layer polarized diffuser is mounted in said door with a top prism side towards one or more full spectrum lamps and a smooth bottom side facing towards objects being illuminated; said fixture includes a means for providing light which is glare free and preferentially vertically polarized; said means comprises said multi-layer polarized diffuser; and said full spectrum fluorescent lamps mounted inside said fixture; said full spectrum fluorescent lamps comprise a means for providing light of excellent color rendition matching the spectral energy distribution of natural daylight; said full spectrum fluorescent lamps being full spectrum fluorescent lamps with a color rendition index of 90 or above and a correlated color temperature of 5,000 degrees Kelvin or above; and a gasket mounted on a door frame of said fluorescent fixture between said door and said door frame; said gasket comprises a means to keep dirt and dust out of said fixture and from collecting on the said top prism surface facing towards said full spectrum fluorescent lamps of said multi-layer polarized diffuser; said gasketing materials are ultraviolet resistant; and a fixture housing free of ventilation holes; said fluorescent fixture to be sealed for dust and light leaks; and a solid state electronic ballast; said ballast comprises a means of providing flicker free lighting; said means including said solid state ballast.

2. The full spectrum polarized lighting system as in claim 1 whereas said full spectrum fluorescent lamps are F40/T10.

3. The full spectrum polarized lighting system as in claim 1 whereas said full spectrum fluorescent lamps are F40/T12.

4. The full spectrum polarized lighting system as in claim 1 whereas said full spectrum fluorescent lamps are F32/T8.

5. The full spectrum polarized lighting system as in claim 1 whereas said ceiling mounted fluorescent fixture is troffer mounted.

* * * * *